US010189685B2

(12) United States Patent
Golden

(10) Patent No.: US 10,189,685 B2
(45) Date of Patent: Jan. 29, 2019

(54) WINDER CABLE GUARD

(71) Applicant: William Golden, North Fort Meyers, FL (US)

(72) Inventor: William Golden, North Fort Meyers, FL (US)

( * ) Notice: Subject to any disclaimer, the term of this patent is extended or adjusted under 35 U.S.C. 154(b) by 122 days.

(21) Appl. No.: 15/344,950

(22) Filed: Nov. 7, 2016

(65) Prior Publication Data

US 2017/0129735 A1 May 11, 2017

Related U.S. Application Data

(60) Provisional application No. 62/251,216, filed on Nov. 5, 2015.

(51) Int. Cl.

| | |
|---|---|
| ***B66D 1/00*** | (2006.01) |
| ***B66D 1/28*** | (2006.01) |
| ***B66D 1/36*** | (2006.01) |
| ***B66D 1/38*** | (2006.01) |
| ***B65H 75/26*** | (2006.01) |
| *B63B 21/16* | (2006.01) |

(52) U.S. Cl.

CPC ..... *B66D 1/00* (2013.01); *B65H 75/26* (2013.01); *B66D 1/28* (2013.01); *B66D 1/36* (2013.01); *B66D 1/38* (2013.01); *B63B 21/16* (2013.01)

(58) Field of Classification Search

CPC ... B66D 1/00; B66D 3/24; B66D 1/30; B66D 3/003; B66D 3/006; B66D 3/20; B66D 1/28; B66D 1/36; B66D 1/38; B66D 1/39; B66D 2700/01; B66D 2700/0125; B66D 2700/0183; B66D 2700/0191; B66D 2700/02; B65H 57/00; B65H 57/02; B65H 57/006; B65H 75/26; B65H 75/4402; B65H 75/4415; B65H 54/388; B65H 54/48; B65H 54/485; B65H 2301/4423; B63B 21/16; B63B 21/18; B63B 21/20; B63B 23/00; B63B 27/00; B63B 23/02

USPC ..... 242/397, 615, 615.4, 548, 548.2, 548.3

See application file for complete search history.

(56) References Cited

U.S. PATENT DOCUMENTS 806,748 A * 12/1905 Nelson ..... B66D 1/36 242/602.2

1,561,459 A * 11/1925 Carse ..... B66D 1/36 242/606

5,328,113 A * 7/1994 de Chevron Villette ..... E06B 9/308 160/170

5,669,575 A * 9/1997 Byle ..... B65H 75/4402 242/470

6,619,365 B1 * 9/2003 Wen ..... E06B 9/322 160/168.1 P 7,104,492 B1 * 9/2006 Massell ..... B66D 1/36 242/397

(Continued)

*Primary Examiner* — Michael R Mansen

*Assistant Examiner* — Raveen J Dias

(74) *Attorney, Agent, or Firm* — William E. Noonan

(57) ABSTRACT

A winder cable guard includes a generally flat plate that is attached to an inwardly facing surface of the outer support bearing in a winder mechanism. The plate is sized and configured to fit within and seal the clearance gap between the outer end of the winder drum and the outer support bearing. This prevents a cable being wound onto the winder drum from slipping or falling into the gap. The potential for jamming and/or breakage of the lift cable is thereby reduced.

14 Claims, 5 Drawing Sheets

(56) References Cited

U.S. PATENT DOCUMENTS

| | | | | |
|---|---|---|---|---|
| 7,389,956 | B2 * | 6/2008 | Hung | E06B 9/322 160/170 |
| 7,520,311 | B2 * | 4/2009 | Drew | E06B 9/322 160/171 |
| 7,607,644 | B1 * | 10/2009 | Gibb | B66F 7/02 254/333 |
| 7,913,978 | B1 * | 3/2011 | Trihey | B66D 3/006 254/323 |
| 2005/0109472 | A1 * | 5/2005 | Lin | E06B 9/322 160/171 |
| 2006/0070706 | A1 * | 4/2006 | Lin | E06B 9/322 160/171 |
| 2006/0237571 | A1 * | 10/2006 | Hsu | B65H 75/48 242/377 |
| 2012/0267592 | A1 * | 10/2012 | Zhao | B66D 1/28 254/266 |

* cited by examiner

WINDER CABLE GUARD

RELATED APPLICATION

This application claims the benefit of U.S. Provisional Patent Application Ser. No. 62/251,216 filed Nov. 5, 2015.

FIELD OF THE INVENTION

This invention relates to a winder cable guard and, more particularly, to a guard or stop device that prevents a section of cable wound on a winder drum from falling or slipping into the gap that is typically formed between an outer end of the winder and an adjacent supportive bearing. The device is particularly effective for use in winders employed in boat lifts.

BACKGROUND OF THE INVENTION

Cable winders are commonly utilized in the boat lift industry as well as other lifting applications. Typically, such winders include an elongate drum or reel that is mounted on an axially rotatable, motor driven shaft. The shaft is, in turn, rotatably supported by a pair of bearings located proximate respective ends of the shaft. The winder drum typically includes a grooved circumferential surface on which the lifting cable is wound.

Conventional boat lift winder mechanisms tend to experience operating problems due to the gap or space that is normally formed between the outer end of the winder drum (i.e. the end opposite the drive motor) and the support bearing located adjacent that end. As the lift is raised and the cable is wound onto the drum, a section of the cable is apt to drop, slip or fall into the gap. This can cause the cable to be pinched, wedged or jammed between the winder drum and the bearing. As a result, the cable cannot travel smoothly and the lifting operation is likely to be disrupted. Moreover, extreme shearing forces are exerted upon the wedged cable, which can immediately or eventually cause the cable to break completely. Sudden cable failure can cause significant and costly damage to the lift and/or the vessel or other item being supported. Tedious, time consuming and very expensive repairs may be required. The lift will be unavailable for use while such repairs are being made.

SUMMARY OF THE INVENTION

It is therefore an object of the present invention to provide a cable winder guard that securely and effectively holds a cable on a winder as the cable is being wound and which prevents the cable from slipping into the gap formed between the winder drum and adjacent support bearing and becoming wedged, pinched or jammed as the cable is wound onto the winder.

It is a further object of this invention to provide a cable winder guard that improves winder operation and reduces winder malfunction, boat lift failure and cable breakage that commonly result when the winder cable becomes caught or jammed between one end of the winder and an adjacent support bearing.

It is a further object of this invention to provide a cable winder guard designed to reduce the significant damage, delays, inconvenience and expense commonly caused by the boat lift cable becoming caught, jammed or pinched between the winder and support bearing.

It is a further object of this invention to provide a cable winder guard that causes a lift cable to be wound in a more uniform, consistent, even and tangle-free manner on a winder so that winder operation is improved considerably.

It is a further object of this invention to provide a cable winder guard that may be utilized with equal effectiveness on both newly manufactured winder mechanisms and on existing winders that are retrofit with the cable guard.

It is a further object of this invention to provide a winder cable guard that is especially effective for use on boat lift winders but which also may be used effectively in other industries.

This invention features a cable guard for a winder mechanism. The winder mechanism includes an elongate winder drum that is supported on a central shaft. The shaft is axially rotatably mounted on a support bearing assembly. A lift cable is wound about the winder drum and a space, gap or clearance (referred to herein as "clearance gap" or simply "gap") is formed between an outer end of the winder drum and an outer bearing of the bearing assembly. The cable guard preferably includes an attachment piece such as a plate or bracket component that is welded or otherwise secured to an inwardly facing surface of the outer bearing such that the plate component is disposed within the gap between the outer end of the winder drum and the outer bearing. The plate component thereby blocks and prevents the cable wound about the circumferential surface of the winder drum from dropping, slipping or being pulled into the clearance gap between the outer end of the winder drum and the outer bearing. As a result, the cable is constrained to remain on the circumferential surface of the winder drum as the cable is wound onto the winder drum.

The plate component of the cable guard may include a lower or bottom edge having a semicircular or otherwise curved recess for accommodating the shaft of the winder mechanism. The plate component typically has a thickness that substantially corresponds to the thickness of the gap or clearance formed between the outer end of the winder drum and the outer bearing. The plate component may include a substantially flat outer face that flushly interengages the outer bearing component. The plate component may include an opposite, substantially flat inner face that carries one more protuberances or projections. The protuberances are positioned on the inside surface of the plate component such that a distal turn of the first, innermost layer of the cable wound upon the winder drum engages the inwardly facing surface of the plate component diametrically inwardly of the protuberances. The cable then commences formation of a diametrically larger second cable layer, which the protuberances constrain and direct such that each successive turn of the cable in the second layer interengages and nests in the valley formed between successive turns of the cable in the underlying layer of wound cable. This causes the cable to be distributed in a uniform and even fashion along the length of the winder drum as the cable is wound onto the drum. Each successive cable turn is received in a respective valley formed between two adjacent turns of the cable in the underlying layer. The innermost cable layer is itself typically accommodated in the spiral groove formed in the circumferential surface of the winder drum.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
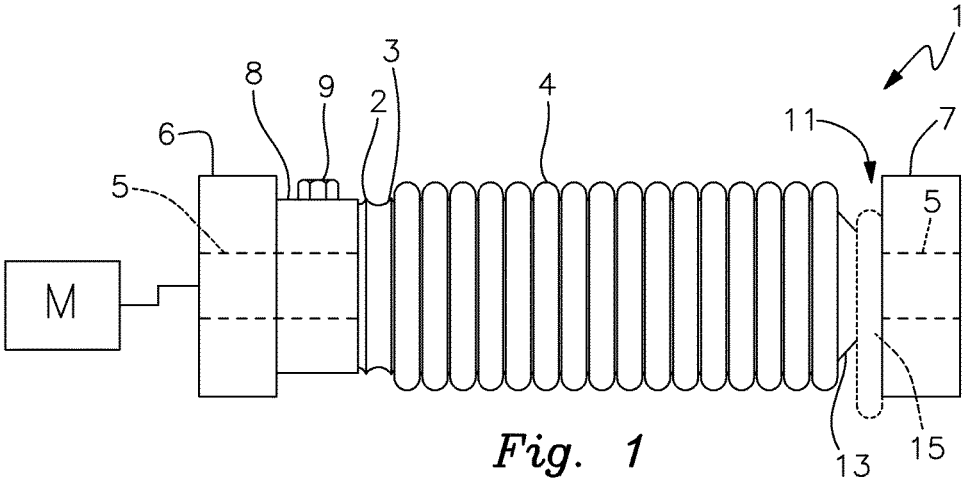
Fig. 1 (Prior Art)
FIG. 1 is a simplified front elevational view of a conventional cable winder mechanism that lacks the cable guard of this invention and, as a result, allows the wound cable to slip off of the winder drum and become wedged between the outer end of the drum and an adjacent support bearing.
Figure 2:
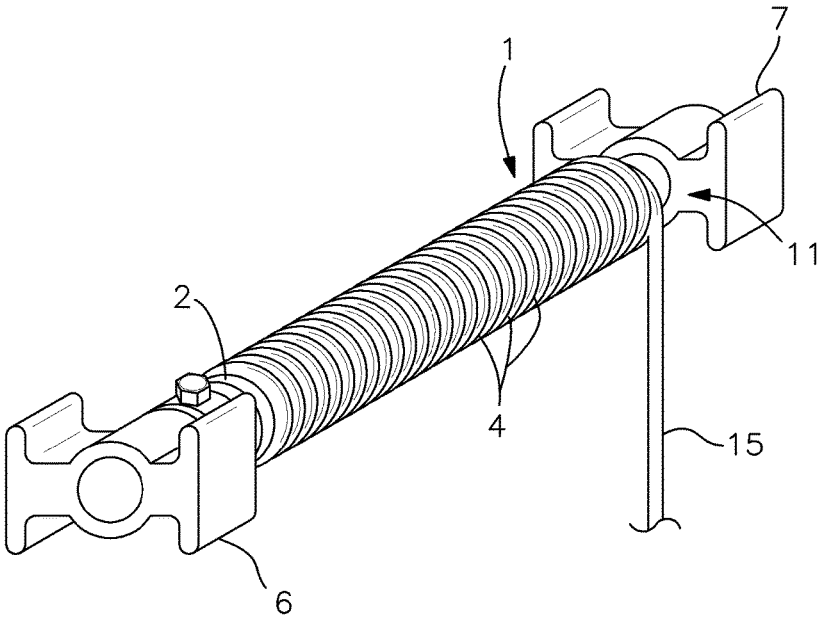
Fig. 2 (Prior Art)
FIG. 2 is a simplified perspective view of a conventional winder mechanism, which again depicts the wound cable being wedged between an outer end of winder drum and an adjacent bearing.

There is shown in FIGS. 1 and 2 a conventional winder mechanism 1 of the type commonly utilized in boat lifts and other lift applications. It should be understood that winder mechanism 1 is simplified somewhat in the drawings, but the construction and operation of the winder mechanism should be well understood by persons skilled in the art. Although the cable guard of this invention is particularly intended for use in boat lift winders, that should not be construed as a limitation on this invention as the disclosed invention may be used in other lift applications wherein a winch or winder drum, reel, spool or other winding component is driven to selectively wind a cable onto or unwind a cable from the circumferential surface of the winder. Although the term winder "drum" is used herein, it should be understood as referring to any and all generally cylindrical components, e.g. reels, spools, winches, etc. that are axially rotated to selectively wind and unwind elongate lifting cables supported thereon. It should also be understood that the lifting cables may comprise virtually any type of durable, flexible element capable of lifting heavy objects. The cable may comprise various compositions (e.g. steel or synthetic fibers and various other metallic or non-metallic compositions which are suitable for lifting boats or other heavy items. The term "cable" should be construed broadly and does not constitute a limitation of this invention.

Winder mechanism 1 includes an elongate, generally cylindrical winder drum 2 having a circumferential surface that includes a standard spiral groove 3 for accommodating an elongate lifting cable 4. Such a grooved circumference is commonly used in boat lift winders. However, in alternative applications, the winder drum may lack grooves and have a generally smooth circumferential surface. The drum may include various lengths. Typically, winder drum 2 is secured to and supported upon a central shaft 5 that is itself axially rotatably mounted in a support bearing assembly comprising a pair of spaced apart support bearings 6 and 7. A standard drive motor M is operatively connected to shaft 5 in a conventional manner. Drum 2 may secured in various ways to the underlying shaft 5. For example, a bushing or collar 8 attached to a proximate end of drum 2 may carry a fastening bolt 9 which extends through bushing 8 and is secured in a standard manner to shaft 5.

As further shown in FIGS. 1 and 2, the winder drum 2 is typically configured and mounted on shaft 5 such that a clearance gap 11 is formed between the distal or outer end 13 of winder drum 2 and outer support bearing 7. This gap is typically up to approximately ¼" wide depending upon the particular winder mechanism involved. This narrow gap exposes a short portion of the supportive shaft 5, as best depicted in FIG. 1. The presence of gap 11 between the outer end of the winder drum and the outer bearing causes operating problems and disadvantages for the winder, as previously discussed. In particular, as shown in FIGS. 1 and 2, as the winder is axially rotated by motor M and cable 4 is wound onto the circumferential surface of winder drum 2, the outer or distal turn 15 of cable 4 has a tendency to slip or drop into gap 11. As previously described, this can cause serious problems. In particular, outer turn 15 of cable 4 tends to become wedged, pinched or jammed within the gap 11 between outer end 13 of winder drum 2 and the inwardly facing surface of bearing 7. In some cases, this can jam the winder mechanism so that the lifting operation is disrupted or stops altogether. In extreme cases and/or over time, such jamming or pinching also subjects the cable to strong shearing forces, which can eventually cause the cable to snap and break. This can be disastrous and cause significant damage to a boat or other item being lifted by the winder mechanism. Not only can the lifted item be seriously damaged, significant time and expense are involved in freeing a jammed cable or replacing a broken or sheared cable.

Figure 3:
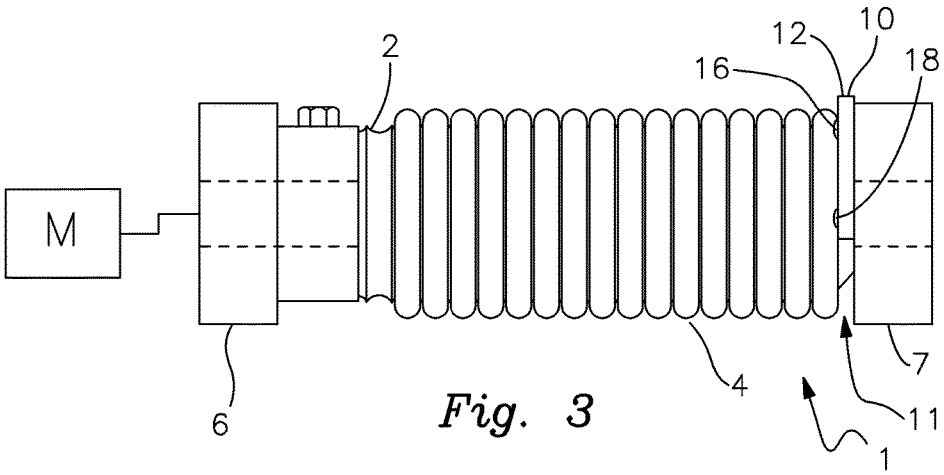
FIG. 3 is a front elevational view of a winder mechanism equipped with the cable guard of this invention such that the cable is blocked from slipping or dropping into the clearance between the winder drum and the bearing.
Figure 4:
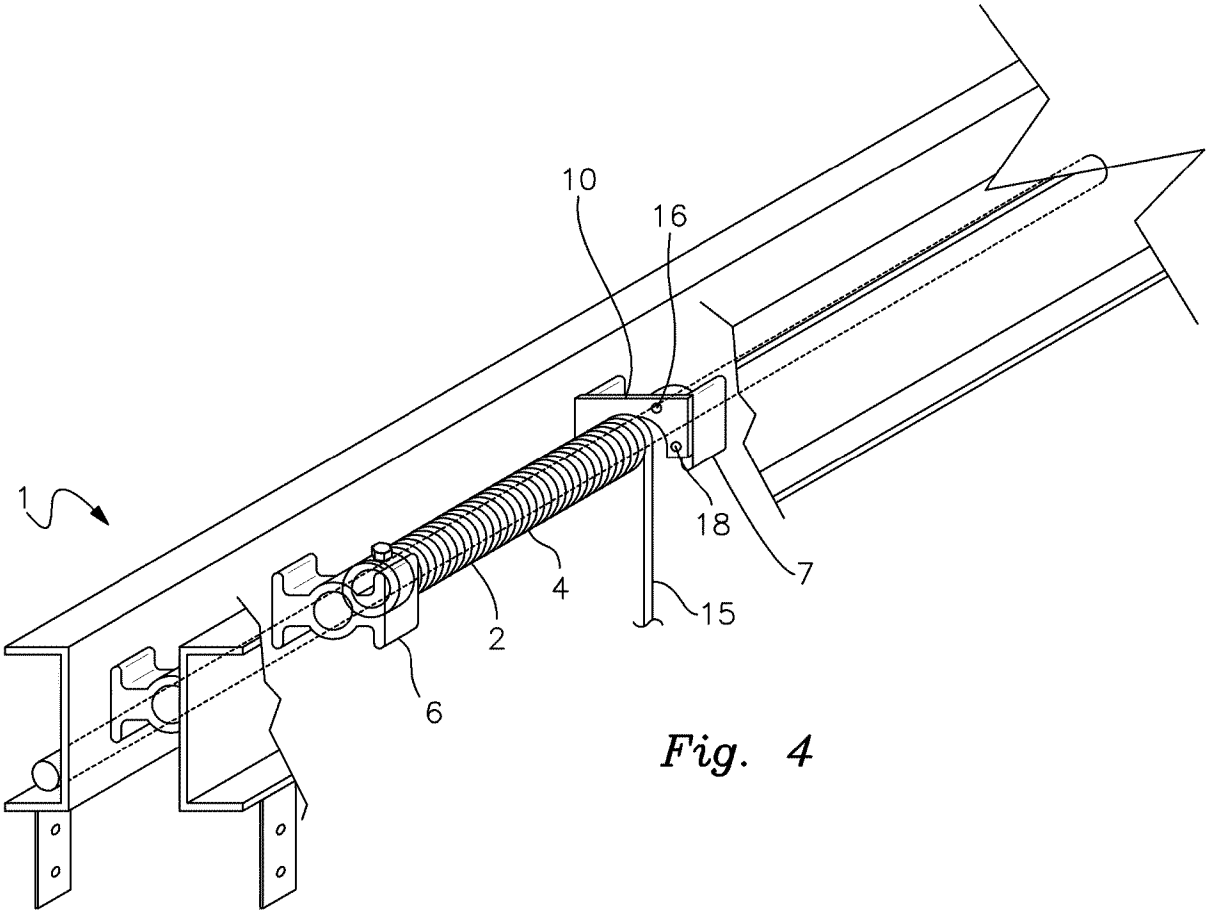
FIG. 4 is a perspective view of the winder mechanism with the cable guard installed.
Figure 5:
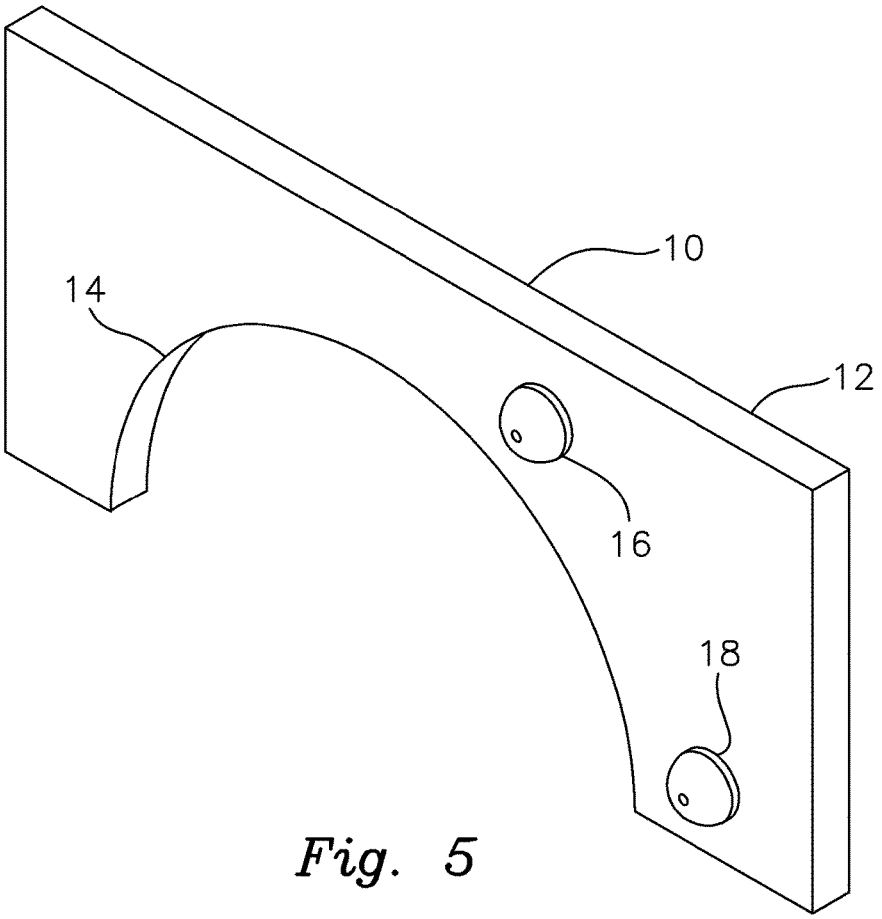
FIG. 5 is a perspective view of the cable guard alone.

As shown in FIGS. 3 and 4, the foregoing problem is remedied by installing cable guard 10 onto the winder mechanism 1. Guard 10, which is shown alone in FIG. 5, comprises an attachment piece in the form of a generally flat plate or bracket 12. The plate has an overall rectangular configuration with a semi-circularly curved recess 14 formed in a bottom edge thereof. More particularly, by way of example, plate 12 may have a width of approximately 5.47", a height of 2.5" and a thickness of 0.25", although these dimensions may be varied within the scope of this invention to fit virtually any existing winder exhibiting a clearance gap as discussed herein. Recess 14 has a preferred radius of approximately 1.8" such that it is able to generally conformably surround winder shaft 5. Plate 12 is typically composed of a durable metal material such as steel or aluminum, although various synthetics and other metals or metal alloys may be employed within the scope of this invention. A pair of bumps or protuberances 16 and 18 are formed on the flat inwardly facing surface of plate 12. These protuberances are positioned and function in a manner that will be described more fully below. In alternative embodiments, the protuberances may be omitted or other numbers and arrangements of protuberances may be utilized. Projections having alternative shapes may also be employed, although the spherical/rounded shape shown in the drawings is especially preferred.

Cable guard 10 is welded or otherwise securely fastened to the inwardly facing surface (i.e. the surface facing the motor) of bearing 7 such that guard 10 fills and seals gap 11 formed between the outer end of winder drum 2 and the inwardly facing surface of bearing 7. More particularly, an outwardly facing surface of plate 12 is welded or otherwise permanently fastened to and flushly interengages the inwardly facing surface of bearing 7. See FIGS. 3 and 4. Guard 10 is positioned within gap 11 such that recess 14 of plate 10 accommodates shaft 5. Guard 10 thereby blocks or seals gap 11 and effectively restricts or prevents cable 4 from slipping or dropping into or otherwise entering the previously exposed gap during a lifting operation as the cable is being wound onto winder drum 2. Guard 10 essentially stops the outwardly directed travel of cable 4 and constrains the cable to remain securely held on the circumferential surface of the winder drum. As a result, wedging, jamming, binding and pinching (collectively referred to herein as "jamming") of the cable between the outer end of the winder drum and the outer bearing are prevented. Shearing and breakage of the cable are also avoided.

Figure 6:
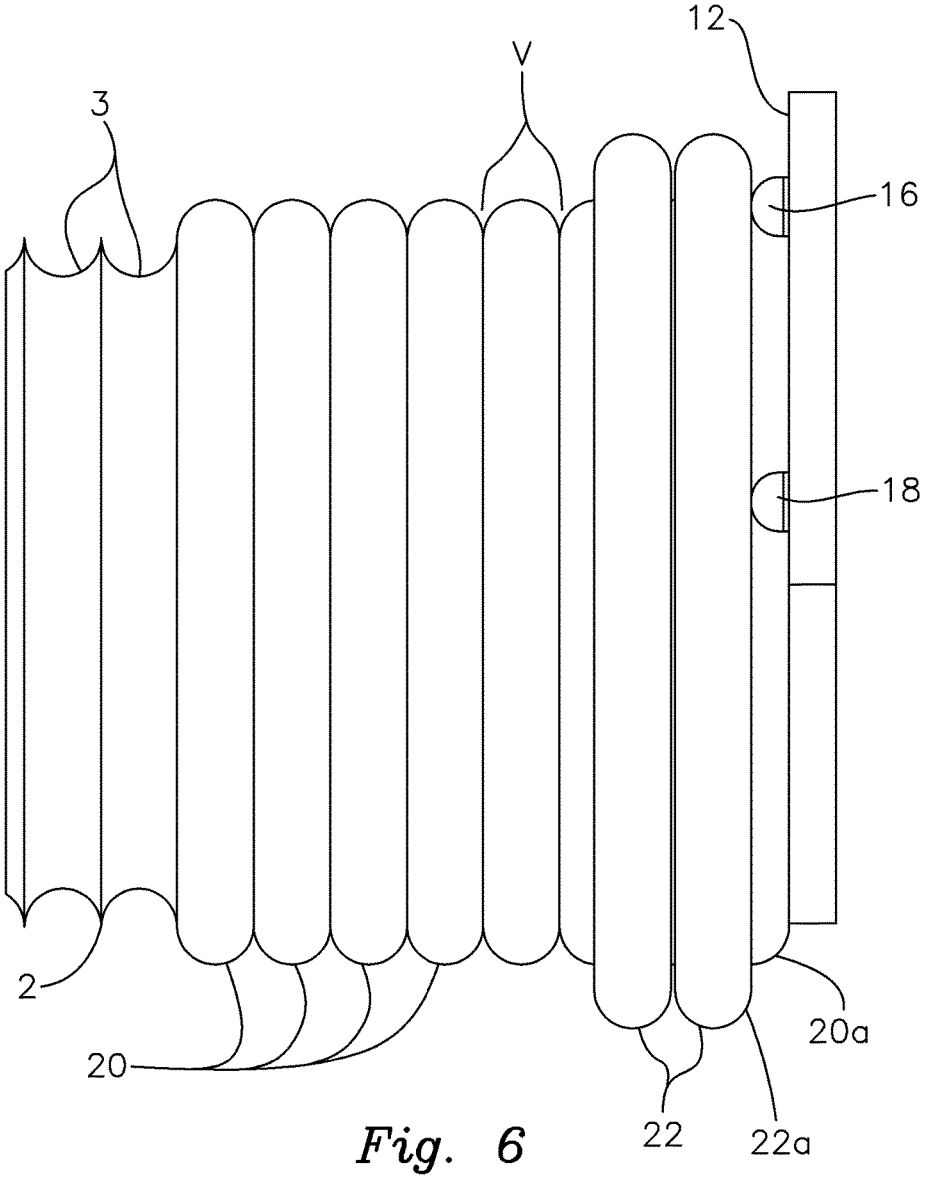
FIG. 6 is a front elevational view of the outer end of the winder drum with the cable guard installed and depicting the manner in which a cable is wound evenly and uniformly upon the winder drum with the protuberances of the cable guard causing an upper layer of cable to be wound upon an underlying cable layer such that each turn of the upper cable layer nests within a valley between two adjacent turns of the in the underlying cable layer.

As further shown in FIG. 6, protuberances 16 and 18 encourage the cable to be evenly and uniformly distributed along the winder as the lifting operation continues. In particular, an inner layer of cable turns 20 are wound upon the winder drum 2 such that each turn of layer 20 is accommodated within a respective section of the spiral groove 3. As the innermost first cable layer reaches the outer end of the winder drum, the outer or first turn 20*a* engages the inwardly facing surface of guard plate 12. The plate stops or blocks the cable from slipping or being pulled into the clearance gap 11 between the outer end of the winder drum and the outer bearing. As the winder continues to turn, a second series of cable turns 22 begin to be formed in an upper layer wound over the underlying cable layer 20. Protuberances 16 and 18 are positioned radially relative to the semicircular recess 14 of guard 10 at a position (diametrically outwardly of the innermost layer of cable turns 20) that allows the outer or final turn of underlying cable layer 20 to engage the inner surface of plate 12 diametrically inside of the protuberances. However, the first cable turn 22*a* of upper or second cable layer 22 engages protuberances 16 and 18 and is effectively pushed or constrained inwardly (back toward the motor) by the rounded protuberances. As a result, as winder drum 2 continues to rotate and successive cable turns of second cable layer 22 are formed, the second cable layer remains spaced apart from the inner face of plate 12, as best shown in FIG. 6. More particularly, the first or outermost turn 22*a* of second layer 22 is effectively constrained or urged by protuberances 16 and 18 to nest in a valley (obscured) formed between innermost cable turn 20*a* of underlying cable layer 20 and the cable turn in layer 20 immediately adjacent and to the left of cable turn 20*a*. In the same manner, each successive cable turn of layer 22 nests in a respective valley V formed between successive adjacent cable turns of the underlying wound cable layer 20. The protuberances thereby cause the cable to be wound uniformly and evenly along the length of the winder drum in successive layers of increasing diameter. This continues until the lifting operation is completed.

In alternative embodiments, the protuberances may be repositioned and other numbers and arrangements of protuberances may be employed to ensure that an analogous operation occurs for successive outer layers of wound cable. Other shapes and sizes of protuberances may be employed. In any event the intended function of such structure is to constrain successive layers of wound cable such that as the winding operation continues, each turn is nested and received in a valley formed between two adjoining turns of the underlying cable. This enables the cable to move uniformly, evenly and smoothly in successive layers along the winder drum as the winder mechanism is operated and the boat or other item is lifted. The cable is less likely to become misaligned and improperly cross or overlap itself while being wound. As a result, winder operation is smoother and subject to fewer disruptions.

The combination of an even and uniform cable winding operation and the effective sealing and blocking of the clearance between the winder drum and its adjacent bearing improve winder operation considerably. Tangling, snagging, binding, pinching and other jamming of the winder cable are reduced dramatically. By the same token, the cable guard greatly reduces the risk of cable shearing and breakage, as well as premature boat lift failure. Damage to lifted vessels or other items, as well as the costs and time delays required to perform repairs are greatly reduced, if not eliminated altogether.

From the foregoing it may be seen that the apparatus of this invention provides for a winder cable guard. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A cable guard for a winder mechanism, which winder mechanism includes an elongate winder drum axially rotatably mounted to a support bearing assembly and a lift cable wound about a circumferential surface of the winder drum and wherein a clearance gap is recessed radially inwardly of the circumferential surface of the winder drum between a longitudinal end of the winder drum and an inwardly facing surface of the support bearing assembly, said cable guard comprising:

an attachment piece for being secured to the inwardly facing surface of the support bearing assembly and positioned in the clearance gap to fill and seal the clearance gap sufficiently to restrict the lift cable from slipping, dropping or otherwise entering into the clearance gap during axial rotation of the winder drum, whereby the cable is constrained to remain on the circumferential surface of the winder drum and jamming and shearing of the lift cable between the winder drum and the support bearing assembly during axial rotation of the winder drum are prevented.

2. The cable guard of claim 1 in which said attachment piece includes a generally flat plate having an outer face for being directed toward and engaging the inwardly facing surface of the support bearing assembly, said attachment piece having an opposite inner face for being directed toward the longitudinal end of the winder drum.

3. The cable guard of claim 2 in which said inner face carries one or more projections for being disposed diametrically outwardly of the circumferential surface of the winder drum and a first, innermost layer of cable turns on the winder drum, said one or more projections for engaging a first turn of a diametrically larger second layer of cable turns to constrain and direct each successive turn of the lift cable in the second layer of cable turns to interengage and nest in a respective valley formed between successive turns of the lift cable in the underlying and innermost first layer of cable turns formed on the winder drum, whereby the lift cable is distributed in a smooth, uniform and even fashion along a length of the winder drum as the lift cable is wound onto the winder drum.

4. The cable guard of claim 3 in which said one or more projections include respective protuberances formed unitarily with said inner face.

5. The cable guard of claim 1 in which the winder drum is mounted to the support bearing assembly by an axial shaft and wherein said attachment piece includes a recess disposed radially inwardly of the outer circumferential surface of the winder drum for accommodating the axial shaft therethrough.

6. The cable guard of claim 1 in which the clearance gap is formed longitudinally beyond the longitudinal end of the winder drum.

7. A cable guard for use in combination with a winder mechanism that includes a lift cable wound about a circumferential surface of an elongate winder drum, said winder drum is axially rotatably mounted by a shaft to a support bearing assembly and wherein a clearance gap recessed radially inwardly of the circumferential surface of the winder drum separates a longitudinal end of the winder drum from the support bearing assembly, the cable guard comprising:

an attachment piece having a top, a bottom and an opposing inner face and an opposing outer face that interconnect said top and bottom; and a recess formed in said bottom of said attachment piece;

said attachment piece for being received in the clearance gap such that said outer face is directed toward an inwardly facing surface of said support bearing assembly and said inner face is directed toward the longitudinal end of the winder drum; said attachment piece for further being attached to the inwardly facing surface of the support bearing assembly such that said recess accommodates the axial shaft and said attachment piece restricts the lift cable from slipping, dropping or otherwise entering into the clearance gap during axial rotation of the winder drum, whereby the lift cable is constrained to remain on a circumferential surface of the winder drum and jamming and shearing of the lift cable between the winder drum and the support bearing assembly during axial rotation of the winder drum are prevented.

8. The cable guard of claim 7 in which said attachment piece includes a generally flat plate.

9. The cable guard of claim 8 in which said inner face carries one or more projections for being disposed diametrically outwardly of the circumferential surface of the winder drum and a first, innermost layer of cable turns on the winder drum, said one or more projections for engaging a first turn of a diametrically larger second layer of cable turns to constrain and direct each successive turn of the lift cable in the second layer of cable turns to interengage and nest in a respective valley formed between successive turns of the lift cable in the underlying and innermost first layer of cable turns formed on the winder drum, whereby the lift cable is distributed in a smooth, uniform and even fashion along a length of the winder drum as is wound onto the winder drum.

10. The cable guard of claim 9 in which said one or more projections include protuberances formed unitarily with said inner face.

11. The cable guard of claim 7 in which said recess includes a concave configuration.

12. The cable guard of claim 7 in which the clearance gap is formed longitudinally beyond the longitudinal end of the winder drum.

13. A cable guard for a winder mechanism, which winder mechanism includes an elongate winder drum axially rotatably mounted to a support bearing assembly and a lift cable wound about a circumferential surface of the winder drum and wherein a clearance gap is formed between a longitudinal end of the winder drum and the support bearing assembly, said cable guard comprising:

an attachment piece for being secured to the support bearing assembly and filling the clearance gap sufficiently to restrict entry of the lift cable into the clearance gap during axial rotation of the winder drum, whereby the lift cable is constrained to remain on the circumferential surface of the winder drum and jamming and shearing of the lift cable between the winder drum and the support bearing assembly during axial rotation of the winder drum are prevented;

said attachment piece including a generally flat plate having an outer face for being directed toward and engaging an outer bearing of the support bearing assembly, said attachment piece having an opposite inner face for being directed toward the longitudinal end of the winder drum; said inner face carrying one or more projections for being disposed diametrically outwardly of a first, innermost layer of cable turns on the winder drum, said one or more projections for engaging a first turn of a diametrically larger second layer of cable turns to constrain and direct each successive turn of the lift cable in the second layer of cable turns to interengage and nest in a respective valley formed between successive turns of the lift cable in the underlying and innermost first layer of cable turns formed on the winder drum, whereby the lift cable is distributed in a smooth, uniform and even fashion along a length of the winder drum as the lift cable is wound onto the winder drum;

said one or more projections including respective protuberances formed unitarily with said inner face.

14. A cable guard for use in combination with a winder mechanism that includes a lift cable wound about an elongate winder drum, which winder drum is axially rotatably mounted by a shaft to a support bearing assembly and wherein a clearance gap separates a longitudinal end of the winder drum from the support bearing assembly, the cable guard comprising:

an attachment piece having a top, a bottom and opposing inner and outer faces that interconnect said top and bottom; and a recess formed in said bottom of said attachment piece;

said attachment piece for being received in the clearance gap such that said outer face is directed toward said support bearing assembly and said inner face is directed toward the longitudinal end of the winder drum; said attachment piece for further being attached to said support bearing assembly such that said recess accommodates the shaft and said attachment piece restricts entry of the lift cable into the clearance gap during axial rotation of the winder drum, whereby the lift cable is constrained to remain on a circumferential surface of the winder drum and jamming and shearing of the lift cable between the winder drum and the support bearing assembly during axial rotation of the winder drum are prevented;

said attachment piece including a generally flat plate; said inner face carrying one or more projections for being disposed diametrically outwardly of a first, innermost layer of cable turns on the winder drum, said one or more projections for projecting a first turn of a diametrically larger second layer of cable turns to constrain and direct each successive turn of the lift cable in the second layer of cable turns to interengage and nest in a respective valley formed between successive turns of the lift cable in the underlying and innermost first layer of cable turns formed on the winder drum, whereby the lift cable is distributed in a smooth, uniform and even fashion along a length of the winder drum as the lift cable is wound onto the winder drum;

said one or more projections including respective protuberances formed unitarily with said inner face.

* * * * *